US011492877B2

(12) United States Patent
McNelis et al.

(10) Patent No.: US 11,492,877 B2
(45) Date of Patent: Nov. 8, 2022

(54) CLOSURE MEMBER AND ENCAPSULATED SLOTTED SHAPED CHARGE WITH CLOSURE MEMBER

(71) Applicant: DynaEnergetics Europe GmbH, Troisdorf (DE)

(72) Inventors: Liam McNelis, Bonn (DE); Arash Shahinpour, Troisdorf (DE); Joerg Mueller, Bonn-Lengsdorf (DE); Frank Haron Preiss, Bonn (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 17/176,335

(22) Filed: Feb. 16, 2021

(65) Prior Publication Data

US 2021/0164330 A1 Jun. 3, 2021

Related U.S. Application Data

(63) Continuation of application No. 16/760,955, filed as application No. PCT/EP2018/080831 on Nov. 9, 2018, now Pat. No. 10,954,760.

(Continued)

(51) Int. Cl.
*E21B 43/117* (2006.01)
*E21B 43/1185* (2006.01)

(Continued)

(52) U.S. Cl.
CPC ..... *E21B 43/117* (2013.01); *E21B 43/1185* (2013.01); *E21B 43/119* (2013.01); *F42B 1/028* (2013.01); *F42B 3/08* (2013.01)

(58) Field of Classification Search
CPC .... F42B 3/08; F42B 3/24; F42B 1/028; E21B 43/117; E21B 43/1185; E21B 43/119

(Continued)

(56) References Cited

U.S. PATENT DOCUMENTS 2,667,836 A 2/1954 Church et al.
3,077,834 A 2/1963 Caldwell (Continued)

FOREIGN PATENT DOCUMENTS

CA 2196385 A1 7/1998
CA 2933762 C 4/2020

(Continued)

OTHER PUBLICATIONS

DMC, Boom Times, Winter 2016 Brochure, DynaSlot System Successfully Deployed in a Variety of Applications Around the Globe, Issue 9, Sep. 16, 2016, 3 pgs.

(Continued)

*Primary Examiner* — Jonathan C Weber
(74) *Attorney, Agent, or Firm* — Moyles IP, LLC

(57) ABSTRACT

A shaped charge closure member for encapsulating a slotted shaped charge is described. The closure member includes a body having a closed upper portion, and a lower portion opposite the upper portion. The closure member has first and second side walls, a front wall, and a back wall. Each wall tapers from the lower portion to the upper portion. A skirt having a substantially rectangular cross-section extends vertically away from each of the walls, at the lower portion of the body. The skirt engages with an open portion of a slotted shaped charge case, thereby forming an encapsulated slotted shaped charge. The encapsulated slotted shaped charge may be used in an exposed perforating gun system.

20 Claims, 4 Drawing Sheets

Related U.S. Application Data

(60) Provisional application No. 62/591,814, filed on Nov. 29, 2017.

(51) Int. Cl.
*E21B 43/119* (2006.01)
*F42B 1/028* (2006.01)
*F42B 3/08* (2006.01)

(58) Field of Classification Search
USPC ..... 102/307, 331, 312, 313
See application file for complete search history.

(56) References Cited

U.S. PATENT DOCUMENTS

| | | | |
|---|---|---|---|
| 3,119,178 | A | 1/1964 | Owen et al. |
| 3,235,005 | A | 2/1966 | Jacques |
| 3,327,630 | A | 6/1967 | Bell |
| 3,589,453 | A | 6/1971 | Venghiattis |
| 3,777,663 | A | 12/1973 | Brown |
| 4,099,464 | A | 7/1978 | Cross et al. |
| 4,109,576 | A | 8/1978 | Eckels |
| 4,273,047 | A | 6/1981 | Rommer |
| 4,387,773 | A | 6/1983 | McPhee |
| 4,496,008 | A | 1/1985 | Pottier et al. |
| 4,784,061 | A | 11/1988 | Christopher |
| 4,817,531 | A | 4/1989 | Walker et al. |
| 4,881,445 | A | 11/1989 | Hayes |
| 4,885,993 | A | 12/1989 | Hancock et al. |
| 5,088,557 | A | 2/1992 | Rides et al. |
| 5,155,293 | A | 10/1992 | Barton |
| 5,248,055 | A | 9/1993 | Sanai et al. |
| 5,505,135 | A | 4/1996 | Fritz et al. |
| 5,792,977 | A | 8/1998 | Chawla |
| 6,098,707 | A | 8/2000 | Pastusek et al. |
| 6,216,596 | B1 | 4/2001 | Wesson |
| 6,378,438 | B1 | 4/2002 | Lussier et al. |
| 6,453,817 | B1 | 9/2002 | Markel et al. |
| 6,684,791 | B1 | 2/2004 | Barnhart |
| 6,925,924 | B2 | 8/2005 | Baker et al. |
| 7,237,486 | B2 | 7/2007 | Myers, Jr. et al. |
| 7,775,279 | B2 | 8/2010 | Marya et al. |
| 7,987,911 | B2 | 8/2011 | Rhodes et al. |
| 8,342,094 | B2 | 1/2013 | Marya et al. |
| 8,544,563 | B2 | 10/2013 | Bourne et al. |
| 9,671,201 | B2 | 6/2017 | Marya et al. |
| 10,240,441 | B2 | 3/2019 | Geerts et al. |
| 10,267,127 | B2 | 4/2019 | Geerts et al. |
| 10,683,735 | B1 | 6/2020 | McCarthy et al. |
| 10,954,760 | B2 | 3/2021 | Mcnelis et al. |
| 2001/0052303 | A1 | 12/2001 | Mayseless et al. |
| 2002/0017214 | A1 | 2/2002 | Jacoby et al. |
| 2002/0189482 | A1 | 12/2002 | Kneisl et al. |
| 2005/0115448 | A1 | 6/2005 | Pratt et al. |
| 2009/0151949 | A1 | 6/2009 | Marya et al. |
| 2011/0094406 | A1 | 4/2011 | Marya et al. |
| 2013/0056208 | A1 | 3/2013 | Xu |
| 2015/0316360 | A1 | 11/2015 | Hinton et al. |
| 2017/0058648 | A1 | 3/2017 | Geerts et al. |

FOREIGN PATENT DOCUMENTS

| | | | |
|---|---|---|---|
| CN | 210598934 | U | 5/2020 |
| CN | 211115936 | U | 7/2020 |
| EP | 1682846 | B1 | 1/2014 |
| GB | 916870 | A | 1/1963 |
| WO | 2001004452 | A1 | 1/2001 |
| WO | 2009117548 | A1 | 9/2009 |
| WO | 2017029240 | A1 | 2/2017 |
| WO | 2018177733 | A1 | 10/2018 |
| WO | 2020150232 | A1 | 7/2020 |

OTHER PUBLICATIONS

DynaEnergetics, Dynaslot System 360° Certainty Well Abandonment, Produce Brochure, 6 pgs., https://www.dynaenergetics.com/en/products/hardware-and-tcp/perforating-gun-systems/dynaslot-gun-system.

International Searching Authority, International Search Report and Written Opinion of International App. No. PCT/EP2018/080831, dated Feb. 15, 2019, 16 pgs.

USPTO, Notice of Allowance for U.S. Appl. No. 16/760,955, dated Dec. 9, 2020, 9 pgs.

USPTO, Office Action of U.S. Appl. No. 16/760,955, dated Aug. 21, 2020, 14 pgs.

China National Intellectual Property Administration; Office Action for CN Application No. 201880088147.7; dated Feb. 25, 2022; 12 pages.

International Searching Authority; International Search Report and Written Opinion of the International Searching Authority for PCT/EP2021/084619; dated Sep. 22, 2021; 13 pages.

International Searching Authority; International Search Report and Written Opinion of the International Searching Authority for PCT/EP2021/063761; dated Nov. 24, 2021; 18 pages.

U.S. Department of Transforation; Classification of Explosives Fourth Revision; dated Jan. 31, 2014; 52 pages.

CLOSURE MEMBER AND ENCAPSULATED SLOTTED SHAPED CHARGE WITH CLOSURE MEMBER

CROSS-REFERENCE TO RELATED APPLICATIONS

This application is a continuation application of and claims priority to U.S. application Ser. No. 16/760,955 filed May 1, 2020, which is a national stage application of and claims priority to Patent Cooperation Treaty (PCT) Application No. PCT/EP2018/080831 filed Nov. 9, 2018, which claims the benefit of U.S. Provisional Application No. 62/591,814 filed Nov. 29, 2017, each of which is incorporated herein by reference in its entirety.

FIELD OF THE DISCLOSURE

A closure member for a shaped charge is generally described. In particular an encapsulated slotted shaped charge including a closure member is described.

BACKGROUND OF THE DISCLOSURE

As part of a well completion process, cased-holes/wellbores are perforated to allow fluid or gas from rock formations (reservoir zones) to flow into the wellbore. Perforating gun string assemblies are conveyed into vertical, deviated or horizontal wellbores, which may include cemented-in casing pipes and other tubulars, by slickline, wireline or tubing conveyance perforating (TCP) mechanisms, and the perforating guns are fired to create openings/perforations in the casings and/or liners, as well as in surrounding formation zones. Such formation zones may include, for example, subterranean oil and gas shale formations, sandstone formations, and/or carbonate formations.

Once the wellbore is no longer producing and/or when a determination is made that the wellbore should be decommissioned, well abandonment procedures are put into place to shut in and permanently seal the wellbore using cement. It is essential that the layers of sedimentary rock, in particular freshwater aquifers, are pressure isolated. Unwanted vertical channels or voids in a previously cemented wellbore annulus may exist. These channels can produce migration pathways for fluids or gas, which may threaten the health and safety of the public. Thus, an objective behind perforating with, for instance, a slotted shaped charge may not be to produce a circular hole in the casing or tubing pipe, but rather to produce a type of longitudinal slot or linear shaped slit or hole in the target pipe, which are particularly useful in performing the above-mentioned abandonment procedures.

Several steps must be taken in order to ensure that the wellbore is properly sealed. Current well abandonment procedures include the use of slotted shaped charges, which are placed in a hollow gun carrier and deployed into the wellbores. The slotted shaped charges are used to perforate (i.e., punch a slot through) the wellbore tubing or casing to provide access for cement squeeze operations. Once detonated, the slotted shaped charges create non-circular slots/openings in a target (such as the tubing/casing within which they are positioned), and a cement slurry is squeezed through those slots in order to fill any voids in the cement sheath to hydraulically seal off the wellbore, an annulus zone between the tubing and/or casing, and/or an area between the casing and the rock formation. The cement squeeze operation allows access to zones which may be otherwise unreachable during abandonment and/or sealing of the wellbore.

One challenge of a successful well abandonment is to provide clean and open slots in the perforated tubing/casing. For example, reliably perforating a large inner diameter (ID) heavy wall casing pipe with a clean and open slot presents a challenge. In particular, high steel wellbore grade casing pipes including walls having thicknesses greater that, e.g., 0.5 inch may be challenging to perforate. In addition, unfavorable slotted perforating performance may result when there is a large clearance gap between a perforating gun and the tubing/casing in which the perforating gun is positioned.

For at least the above reasons, there is a need for a device and method that provides 360 degree access to any potential voids, pockets or channels in a previously cemented layer surrounding a tubing/casing, while reliably perforating tubing/casing wall pipes regardless of their wall thickness and/or inner diameter. The present disclosure addresses these needs, among other things, and also provides a slotted shaped charge that can be used in an exposed perforating gun system.

BRIEF DESCRIPTION OF THE EXEMPLARY EMBODIMENTS

According to an aspect, exemplary embodiments of a shaped charge closure member are disclosed. Such shaped charge closure members are useful for encapsulating slotted shaped charges, so that the slotted shaped charges can be used in well completion/abandonment procedures.

One exemplary shaped charge closure member is configured to encapsulate an open end of a slotted shaped charge. According to an aspect, the exemplary shaped charge closure member includes a body having a closed upper portion, and a lower portion opposite the upper portion. The body includes a first side wall, a second side wall, a front wall, and a back wall. Each wall extends between the upper portion and the lower portion. The body of the closure member is tapered, with the closed upper portion defining an area that is smaller than the lower portion. A skirt having a substantially rectangular cross-section vertically extends away from each of the walls, at the lower portion of the body.

In a further aspect, exemplary embodiments of an encapsulated slotted shaped charge are disclosed. One exemplary slotted shaped charge includes a substantially rectangular case having a closed portion and an open portion. A cavity extends between the open and closed portions, and an explosive load is disposed within the cavity. A liner is disposed adjacent the explosive load and retains the explosive load within the cavity. The encapsulated slotted shaped charge includes a shaped charge closure member configured to close the open portion of the case. The closure member may be configured in accordance with the exemplary disclosed embodiments of a shaped charge closure member. The skirt of the closure member is configured to engage with the case at the open portion.

According to an aspect, the exemplary disclosed encapsulated slotted shaped charges may be configured for use in an exposed perforating gun system. The exposed perforating gun system includes a carrier tube having one or more openings. One encapsulated slotted shaped charge is disposed in each of the openings of the carrier tube, and is mechanically fixated therein.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
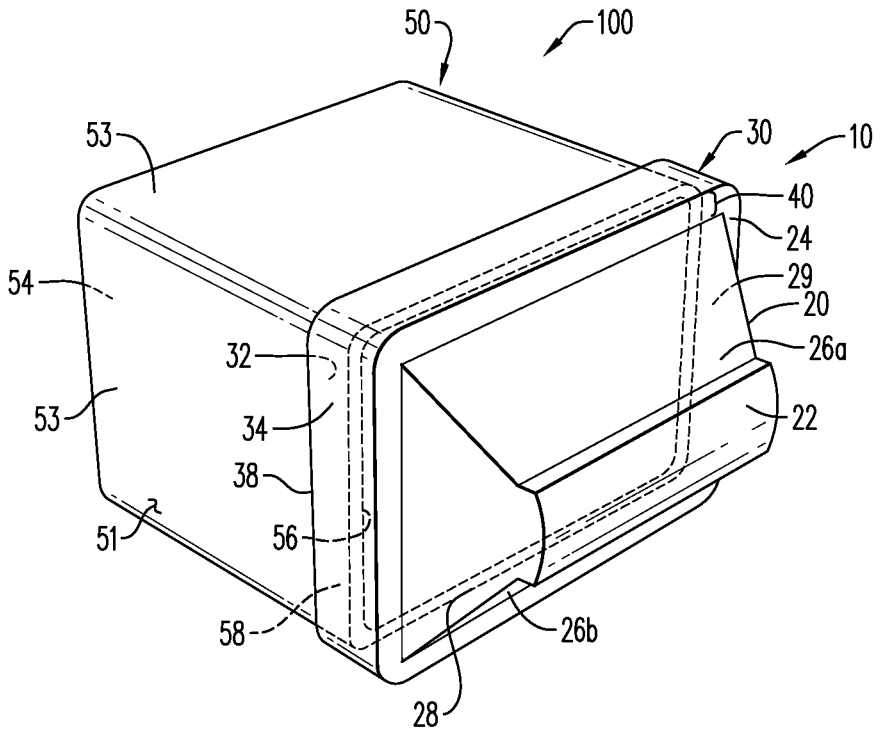
FIG. 1 is a perspective view of an encapsulated slotted charge, according to an exemplary embodiment.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

For purposes of illustrating features of the embodiments, embodiments will now be introduced and referenced throughout the disclosure. Those skilled in the art will recognize that this example is illustrative and not limiting and is provided purely for explanatory purposes.

Figure 2:
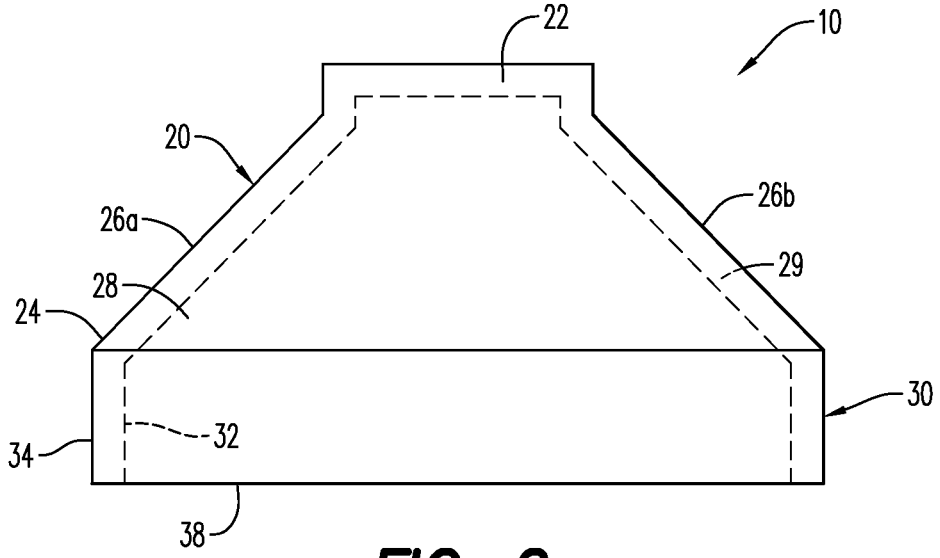
FIG. 2 illustrates a front view of an exemplary closure member, according to an aspect.
Figure 3:
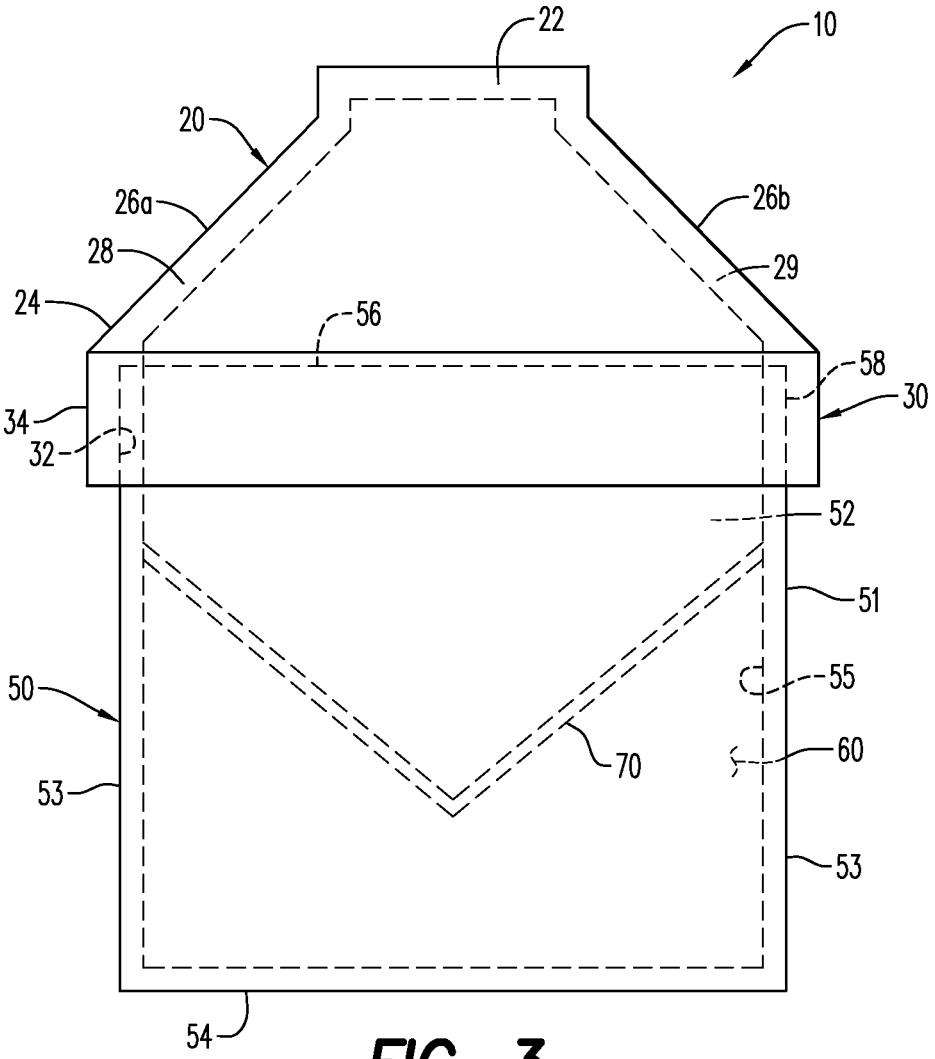
FIG. 3 illustrates a front view of an exemplary encapsulated slotted charge, including the closure member of FIG. 2.

In the illustrative examples and as seen in FIGS. 1-3, an exemplary shaped charge closure member 10 for use with a slotted or substantially rectangular shaped charge is illustrated. The closure member 10 is configured to encapsulate an open end of the slotted shaped charge.

The closure member 10 includes a body 20 having a closed upper portion 22 and a lower portion 24 opposite and spaced apart from the upper portion 22. In the exemplary embodiment illustrated in FIGS. 1-3, the lower portion 24 is open. The body 20 includes a hollow interior or cavity that is defined, at least in part, by the closed upper portion 22 and the lower portion 24. The closed upper portion 22 defines an area that is smaller than the lower portion 24. FIGS. 2-3 illustrate the closed upper portion 22 having a substantially planar surface. As would be understood by one of ordinary skill in the art, the surface of the closed upper portion 22 may be configured in any manner so as to adjust the space/size of the hollow interior of the body 20. In the exemplary embodiment shown in FIG. 1, the closed upper portion 22 includes an outwardly curved surface. Alternatively, the closed upper portion 22 may have a substantially planar surface, as illustrated in FIGS. 2-3.

According to an aspect, the body 20 includes a plurality of walls, namely a first side wall 26*a*, a second side wall 26*b* opposite the first side wall 26*a*, a front wall 28, and a back wall 29 opposite the front wall 28. While the first and second side walls 26*a*, 26*b* and the front and back walls 28, 29 are illustrated in FIGS. 1 and 3 as having planar surfaces, it is contemplated that each may have a rounded surface. The first side wall 26*a* and the second side wall 26*b* are generally perpendicular to the front wall 28, and are generally perpendicular to the back wall 29. As used herein "generally perpendicular" means that a first plane, edge, surface, etc. of a wall is oriented at approximately 90 degrees from another plane, edge, surface, etc. of another wall. For instance, the front wall 28 is connected to the first side wall 26*a* at an angle of approximately 90 degrees.

Each of the first side wall 26*a*, the second side wall 26*b*, the front wall 28, and the back wall 29 extends between the upper portion 22 and the lower portion 24 of the body 20. According to an aspect and as illustrated in FIG. 1, each of the front wall 28 and the back wall 29 tapers from the lower portion 24 to the closed upper portion 22. Each of the first and second side walls 26*a*, 26*b* may also taper in a direction from the lower portion 24 to the closed upper portion 22. (FIGS. 2-3). In the exemplary embodiment shown in FIGS. 1-3, the front wall 28 and the back wall 29 each have a substantially trapezoidal shape, while the first side wall 26*a* and the second side wall 26*b* each have a substantially rectangular shape. Alternatively, the front wall 28 and the back wall 29 may each have a rectangular shape, while the first side wall 26*a* and the second side wall 26*b* each have a substantially trapezoidal shape. In the same or other embodiments, the first side wall 26*a*, the second side wall 26*b*, the front wall 28, and the back wall 29 may each have any shape for a particular application, consistent with this disclosure.

The exemplary closure member 10 includes a skirt 30. The skirt 30 extends vertically away from the first and second side walls 26*a*, 26*b*, the front wall 28 and the back wall 29. The skirt 30 has a substantially rectangular cross-section, and is configured to engage the open end of slotted or substantially rectangular shaped charges. According to an aspect, the skirt 30 has an inner surface 32 and an outer surface 34. The inner surface 32 is configured to engage the open end of the slotted shaped charge, so that the closure member 10 can encapsulate and hydraulically seal the slotted shaped charge. As illustrated in FIG. 4, the skirt 30 includes a protrusion 36 that extends radially from the inner surface 32 of the skirt 30. The protrusion 36 extends laterally along the inner surface 32 of the skirt 30, and is configured to frictionally or compressionally engage a case of a slotted shaped charge (FIGS. 1 and 3) so that the closure member 10 can be at least temporarily secured thereto.

According to an aspect, the skirt 30 is integrally formed with or extends directly from the first and second side walls 26*a*, 26*b*, the front wall 28 and the back wall 29. According to an aspect, and as illustrated in FIG. 1, the skirt 30 is connected to an end of a shoulder portion 40, while another end of the shoulder portion 40 is connected to the first and second side walls 26*a*, 26*b*, the front wall 28 and the back wall 29. Thus, the shoulder portion 40 extends between the skirt 30 and each of the first and second side walls 26*a*, 26*b*, the front wall 28, and the back wall 29. The shoulder portion 40 may extend laterally between the skirt 30 and each wall, so that the skirt 30 can cover surface area that is greater than the surface area at the lower portion of the body 20.

Figure 4A:
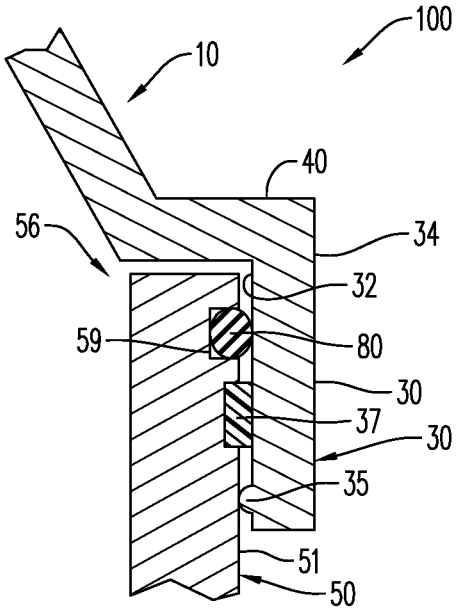
FIG. 4A illustrates an engagement between a closure member and a slotted charge, according to an aspect.
Figure 4B:
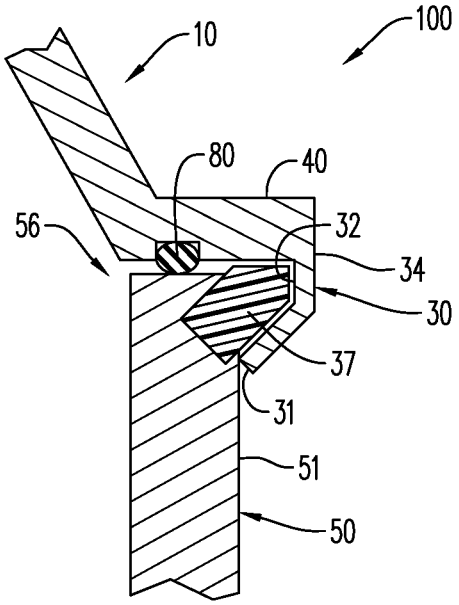
FIG. 4B illustrates another engagement between a closure member and a slotted charge, according to an aspect.

The closure member 10 may include a sealing member 80 (FIGS. 4A, 4B). The sealing member 80 may be positioned at any position between adjacent surfaces of the closure member 10 and the case 50 of the slotted shaped charge (FIGS. 1 and 3) upon which the closure member 10 is situated. FIG. 4A illustrates the sealing member 80 adjacent an inner surface 32 of the skirt 30. In an embodiment and as illustrated in FIG. 4B, the sealing member 80 is adjacent an inner surface of the shoulder portion 40. In the exemplary embodiment shown in FIGS. 4A and 4B, the sealing member 80 is an O-ring. In other exemplary embodiments, the sealing member 80 is a Lip-Seal. In still further embodiments, the sealing member 80 may be any known sealing device consistent with this disclosure. As illustrated in FIGS. 4A-4B, a melting ring 37 may be provided to further secure the closure member 10 to the case 50 of the slotted shaped charge and enhance the seal between the closure member 10 and the case 50 of the slotted shaped charge.

According to an aspect, the closure member 10 is formed by an injection molding process. The closure member 10 may be formed from at least one of a polymeric material, a thermoplastic material, and an elastomeric material. The closure member 10, including the body 20, the skirt 30 and in some instance the shoulder 40, may be formed of a rigid material, such as a machinable polymer, steel, copper, brass, and/or aluminum. According to an aspect, the closure member 10 may be formed from polyvinyl chloride (PVC), which may be particularly suited for cement squeeze operations, or operations in which the closure member 10 is used to close slotted shaped charges to be used in wellbores having shallow depths. Examples of polymers that may form the closure member 10 include rigid thermoplastics, including, but not limited to polyethylene (PE), polypropylene (PP), polycarbonate (PC), polystyrene (PS), nylon (aka polyamide (PA)), polyester (typically polyethylene terephthalate (PET)), polyalkelene glycol (PAG) with or without glass fiber, polyetheretherketone (PEEK), or silicone. These materials are available as a homopolymer, or co-polymer. Glass fibers may be included in the polymer to help increase their strength. According to an aspect, the glass fibers are about 5% to about 40% by weight of the polymer. Exemplary nylons include nylon 6 (PA6), nylon 66 (PA66), nylon 6/6-6, nylon 6/9, nylon 6/10, nylon 6/12, nylon 11, nylon 12. Nylons may also be blended with other engineering plastics to improve certain aspects of performance. Nylon may be processed by injection molding, rotational molding, or casting. Exemplary polyethylene compounds include high density polyethylene (HDPE), low density polyethylene (LPDE) and linear low density polyethylene (LLPDE).

FIGS. 1 and 3 illustrate an encapsulated slotted shaped charge (i.e., a hermetically sealed slotted shaped charge) 100 including a closure member 10. The encapsulated slotted shaped charge 100 includes substantially rectangular case 50. The case 20 may be formed from machinable steel, aluminum, stainless-steel, copper, zinc material, and the like. FIG. 3 illustrates the case 50 having a closed portion 54 and an open portion 56 opposite the closed portion 54. A plurality of side walls 53 extend between the closed and open portions 54, 56. According to an aspect, each surface of the case 50 is planar, such as the surfaces of the closed portion 54 and each of the side walls 53. A cavity 52 extends between the closed and open portions 54, 56, and is bound in part by the side walls 53 and the closed portion 54.

As illustrated in FIG. 3, the shaped charge 100 may include an explosive load 60 disposed or enclosed within the cavity 52 of the case 50. The explosive load 60 may abut the closed portion 54 and at least a portion of each side wall 53. The explosive load 60 may extend along an interior surface 55 of the shaped charge case 50. In an embodiment, the explosive load 60 includes at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), 2,6-Bis(picrylamino)-3,5-dinitropyridine/picrylaminodinitropyridin (PYX), hexanitrostibane (HNS), and triaminotrinitrobenzol (TATB). According to an aspect, the explosive load 60 includes at least one of hexanitrostibane (HNS) and diamino-3,5-dinitropyrazine-1-oxide (LLM-105). The explosive load may include a mixture of PYX and TATB. As illustrated in FIG. 3, the explosive load 60 may be a main explosive load. It is contemplated, however that the explosive load 60 may include a primary explosive load and a secondary explosive load, with the primary explosive load abutting the closed portion 54 and the secondary explosive load being in a covering relationship with the primary explosive load.

A liner 70 may be disposed adjacent the explosive load 60. The liner 70 is configured for retaining the explosive load 60 within the cavity 52 of the case 50. In the exemplary embodiment shown in FIG. 7, the liner 70 has a conical configuration. In other exemplary embodiments, the liner 70 has a hemispherical configuration. In further embodiments, the liner 70 has a tulip configuration. In still further embodiments, the liner 70 may be any known configuration consistent with this disclosure. The liner 70 may be made of a material selected based on the target to be penetrated and may include, for example and without limitation, a plurality of powdered metals or metal alloys that are compressed to form the desired liner shape. Exemplary powdered metals and/or metal alloys include copper, tungsten, lead, nickel, bronze, molybdenum, titanium and combinations thereof. In some embodiments, the liner 70 is made of a formed solid metal sheet, rather than compressed powdered metal and/or metal alloys. In another embodiment, the liner 70 is made of a non-metal material, such as glass, cement, high-density composite or plastic. Typical liner constituents and formation techniques are further described in commonly-owned U.S. patent application Ser. No. 15/499,408, which is incorporated by reference herein in its entirety to the extent that it is consistent with this disclosure. When the encapsulated shaped charge 100 is initiated, the explosive load 60 detonates and creates a detonation wave that causes the liner 70 to collapse and be expelled from the shaped charge 100. The expelled liner 70 produces a forward-moving perforating jet that moves at a high velocity.

The encapsulated slotted shaped charge 100 includes a closure member 10 positioned in a covering relationship with the open portion 56 of the case 50, which closes the slotted shaped charge 100. In the exemplary embodiments shown in FIGS. 1 and 3, the closure member 10 is a shaped charge closure member in accordance with the exemplary disclosed embodiments of a shaped charge closure member, e.g., as discussed above. Thus, for the purpose of convenience and not limitation, the various features, attributes, properties, and functionality of the closure member 10 are not repeated here.

As described hereinabove, the body 20 of closure member 10 includes a hollow interior defined, at least in part, by the closed upper portion 22 and the lower portion 24. The hollow interior provides sufficient space/an air gap for the forward-moving jet created by the expelled liner 70 to adequately form its shape upon detonation of the slotted shaped charge. The space helps to ensure that once the jet has properly formed, it will fully develop and achieve maximum velocity prior to piercing the surface of the closed upper portion 22 of the closure member 10.

The skirt 30 of the closure member 10 is configured to engage the case 50 of the slotted shaped charge 100 at the open portion 56. As illustrated in FIGS. 1 and 3, the skirt 30 is positioned over a shoulder 58 adjacent the open portion 56 of the case 50. According to an aspect, the inner surface 32 of the skirt 30 may frictionally engage with at least a portion of an external surface 51 of the case 50.

According to an aspect and as illustrated in FIGS. 4A-4B, the closure member 10 is secured to the shoulder 58 of the case 50 by one or more securing devices/securing mechanisms. The securing mechanism is constructed and arranged so that closure member 10 can be maintained in a covering relationship with the case 50. As described hereinabove, the shoulder 58 may frictionally engage the closure member 10 or the closure member 10 may compressionally engage the shoulder 58 in a manner that secures the closure member 10 on the case 50. As illustrated in FIG. 4A, the shoulder 58 includes a groove 59. The groove 59 extends inwardly from an external surface 51 of the case 50 towards the cavity 52. According to an aspect, the groove 59 is formed by removal of material from the external surface 51 of the case. The groove 59 may alternatively be formed by stamping into the external surface 51 of the case 50. The skirt 30 may include an engagement member 35 that engages with the external surface 51 and/or the groove 59 of the case. According to an aspect and as illustrated in FIG. 4A, the engagement member 35 may be a protrusion that extends along the inner surface 32 of the skirt 30. In an embodiment and as illustrated in FIG. 4B, the engagement member 35 a free end 31 of the skirt 30 deformed towards the external surface 51 of the case 50. The engagement member 35 may engage with, be received or secured in a depression formed at the open portion 56 of the case 50, thereby securedly fastening the closure member 10 to the case 50.

A melting ring 37 may be positioned between the shoulder 58 of the case 50 and the inner surface 32 of the skirt. In the exemplary embodiment shown in FIG. 4A, the melting ring 37 is adjacent the external surface 51 of the case 50 and between the external surface 51 of the case 50 and the skirt 30 of closure member 10. In the exemplary embodiment shown in FIG. 4B, the melting ring 37 is between the external surface 51 of the case 50 and the free end 31 of the skirt 30. The melting ring 37 may be formed of a deformable material such as, for example and without limitation, polyamide. According to an aspect, the melting ring 37 in part secures the closure member 10 to the case 50 such that the closure member 10 cannot be dislodged from the case 50 prior to detonation of the encapsulated slotted shaped charge 100. The melting ring 37 also helps prevent an internal pressure build up and potential gas explosion, particularly if the encapsulated slotted shaped charge 100 is exposed to high temperatures, such as those of a fire or unusually high wellbore temperatures.

The closure member 10 is configured to prevent the contents of the slotted shaped charge 100 from being exposed to wellbore fluids and/or high temperatures. According to an aspect, sealing member 80 may be positioned at one or more locations between the case 50 and the skirt 30. According to an aspect, the sealing member 80 may be positioned at one or more positions between the shoulder 58 of the case 50 and the closure member 10. As illustrated in FIG. 4A, the sealing member 80 may be seated in the groove 59, and may be compressed between the external surface 51 of the case 50 and the inner surface 32 of the skirt 30 of the closure member 10. In the exemplary embodiment shown in FIG. 4B, the sealing member 80 may be positioned between the peripheral edge of the open portion 56 of the case 50 and the shoulder portion 40 of the closure member 10. In an embodiment, at least one of the sealing members 80 is one of an O-ring and a Lip-seal positioned between the closure member 80 and a position adjacent the open portion 56. The sealing member 80 isolates pressure outside the shaped charge 100 from any pressure within the shaped charge 100 and thereby prevents pressure located outside of the shaped charge 100 from impacting the pressure of internal space of the shaped charge 100, such as the cavity 52 of the shaped charge 100. Together, the sealing member 80 and the closure member 10 are operative for providing a seal between the case 50 and the closure member 10.

Figure 5:
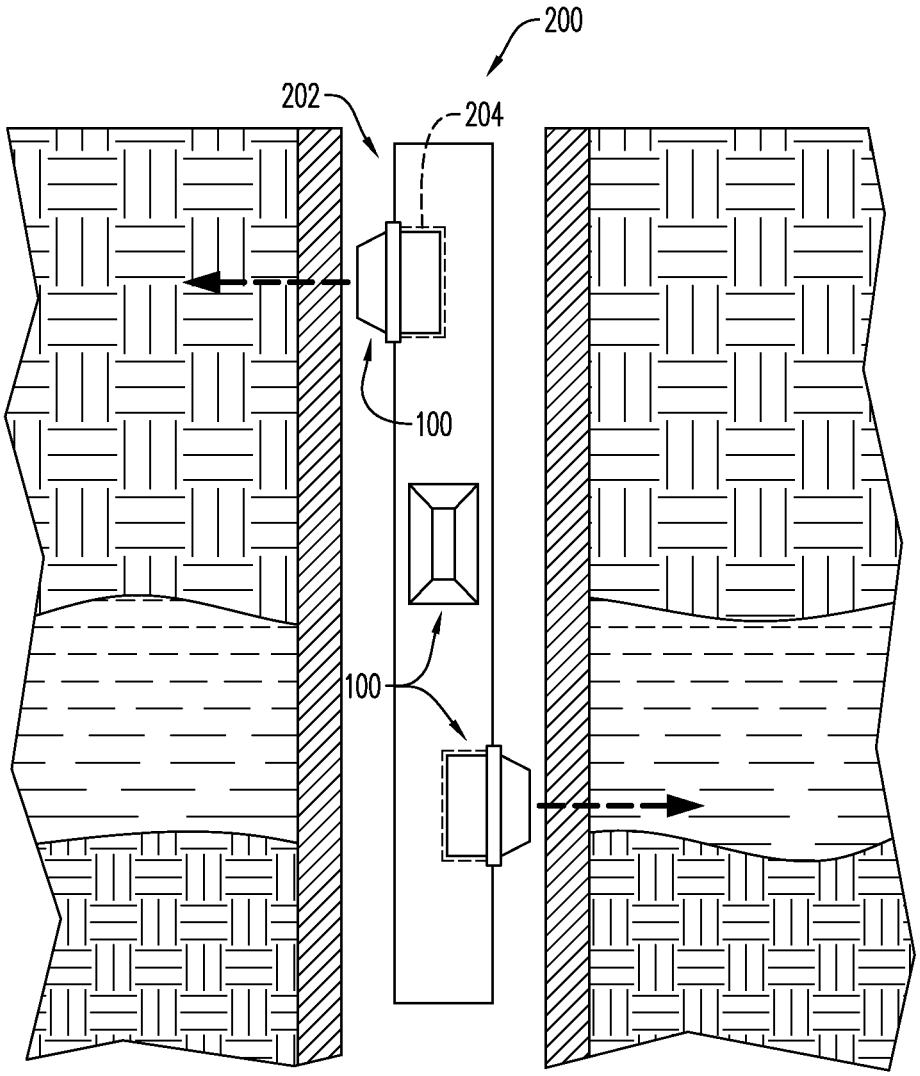
FIG. 5 illustrates an exposed perforating gun system including encapsulated slotted shaped charges, according to an aspect.

With reference now to FIG. 5, an exemplary embodiment of an exposed perforating gun system 200 according to the disclosure is shown. According to an aspect, the exposed perforating gun system 200 may include a carrier frame (not shown) or a carrier tube 202. FIG. 5 illustrates the exposed perforating gun system including the carrier tube 202. The carrier tube 202 is illustrated as an open carrier tube that includes one or more openings 204. In the exemplary embodiment shown in FIG. 5, the openings 204 are disposed about the carrier tube 202 in a substantially helical configuration. Each opening 204 is sized and shaped to receive and mechanically fixate one encapsulated slotted shaped charge therein. The exemplary encapsulated slotted shaped charges according to the disclosure may be used in an open carrier. Thus, it is not necessary to enclose the exemplary encapsulated slotted shaped charges in a heavy perforating gun casing (such as a tubular gun carrier) through which the charges would initially have to penetrate. The exemplary encapsulated slotted shaped charges can therefore reliably perforate clean and open slots in large inner diameter heavy wall casing, tubing, pipe, etc.

In the perforating gun system 200 shown in FIG. 5, the encapsulated slotted shaped charges are helically oriented. The encapsulated slotted shaped charges may be fastened along a spiral carrier frame and positioned within a surrounding carrier tube (not shown). Such perforating gun casings/systems are described in commonly-assigned U.S. Pat. No. 9,494,021, which is incorporated herein by reference in its entirety.

Exemplary embodiments of a method of encapsulating or hydraulically sealing a slotted shaped charge according to the disclosure include providing a slotted shaped charge having a substantially rectangular case, according to the exemplary disclosed embodiments of a slotted shaped charge, e.g., as discussed above. The substantially rectangular case has a closed portion, an open portion, and a cavity between the closed portion and the open portion. The exemplary methods include attaching a closure member, configured according to the exemplary disclosed embodiments of a closure member, e.g., as discussed above, to the rectangular case at its open portion. A sealing member is inserted into the groove of the shape charge case or adjacent the inner surface of the skirt. According to an aspect, a melting ring may also be positioned between either the external surface of the case and the inner surface of the skirt, or the open portion of the case and a free end of the skirt. The body of the closure member is placed adjacent the open portion of the case, such that the skirt extends around the shoulder of the case and the body of the closure member is in a covering relationship with the open portion of the case. The case is pressed into place until the engagement member is seated in its intention position, as illustrated in FIG. 4*a*. In an embodiment, the free end of the skirt is compressed against the melting ring so that the body is mechanically fixed/secured onto the case. The skirt may be crimped onto the open portion of the case.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A shaped charge closure member, comprising:

a body having a hollow interior and comprising:

a closed upper portion, a lower portion opposite the closed upper portion, a first planar side wall extending between the closed upper portion and the lower portion, a second planar side wall spaced apart from the first planar side wall, and extending between the closed upper portion and the lower portion, a front wall extending between the first planar side wall and the second planar side wall, and a back wall opposite and spaced apart from the front wall, and extending between the first planar side wall and the second planar side wall, wherein a surface of the closed upper portion extends from an upper portion of the first planar side wall to an upper portion of the second planar side wall and has a curved profile therebetween, wherein the curved profile includes a portion of the surface extending in a direction away from the upper portions of the first planar side wall and the second planar side wall.

2. The closure member of claim 1, wherein:

the first and second planar side walls have a substantially trapezoidal shape; and the front wall and the back wall have a substantially rectangular shape.

3. The closure member of claim 1, further comprising:

a skirt extending downwardly from each of the first and second planar side walls, the front wall and the back wall, wherein the skirt has a substantially rectangular cross-section.

4. The closure member of claim 3, wherein the skirt comprises an engagement member on an inner surface of the skirt, the engagement member being configured to frictionally or compressionally engage a slotted shaped charge.

5. The closure member of claim 3, wherein the body and the skirt are composed of at least one of machinable polymer, steel, copper, brass, and aluminum.

6. An encapsulated slotted shaped charge comprising:

a rectangular case having a cavity, a closed portion and an open portion; and a shaped charge closure member comprising a body having a hollow interior and comprising:

a closed upper portion, a lower portion opposite the closed upper portion, the lower portion defining an area that is larger than the closed upper portion, a first planar side wall extending between the closed upper portion and the lower portion, a second planar side wall spaced apart from the first planar side wall, and extending between the closed upper portion and the lower portion, a front wall extending between the first planar side wall and the second planar side wall, and a back wall opposite and spaced apart from the front wall, and extending between the first planar side wall and the second planar side wall, wherein a surface of the closed upper portion extends from an upper portion of the first planar side wall to an upper portion of the second planar side wall and has a curved profile therebetween, wherein the curved profile includes a portion of the surface extending in a direction away from the upper portions of the first planar side wall and the second planar side wall.

7. The encapsulated slotted shaped charge of claim 6, wherein the shaped charge closure member further comprises:

a skirt extending downwardly from each of the first and second planar side walls, the front wall, and the back wall, wherein the skirt has a substantially rectangular cross-section and is positioned over the open portion of the rectangular case.

8. The encapsulated slotted shaped charge of claim 6, wherein the shaped charge closure member further comprises:

a shoulder portion extending laterally between a lower portion of each of the first and second planar side walls, the planar front wall, and the planar back wall, and the skirt.

9. The encapsulated slotted shaped charge of claim 7, wherein an inner surface of the skirt engages an external surface of the rectangular case.

10. The encapsulated slotted shaped charge of claim 8, wherein the inner surface of the skirt comprises an engagement member that engages the external surface of the rectangular case.

11. The encapsulated slotted shaped charge of claim 6, further comprising at least one of a compressible sealing member and a melting ring disposed between an external surface of the rectangular case and an inner surface of the skirt.

12. The encapsulated slotted shaped charge of claim 6, wherein the shaped charge closure member is composed of one of machinable polymer, steel, copper, brass, and aluminum.

13. The encapsulated slotted shaped charge of claim 6, wherein the shaped charge closure member is composed of a polymer comprising a thermoplastic material.

14. The encapsulated slotted shaped charge of claim 6, wherein:

the first and second planar side walls have a substantially trapezoidal shape; and the planar front wall and the planar back wall have a substantially rectangular shape.

15. An exposed perforating gun system comprising:

a shaped charge carrier;

an encapsulated slotted shaped charge mechanically fixated in the shaped charge carrier, the encapsulated slotted shaped charge comprising:

a rectangular case having a cavity, a closed portion and an open portion, and a shaped charge closure member comprising:

a body having a hollow interior and comprising:

a closed upper portion, a lower portion opposite the closed upper portion, a first planar side wall extending between the closed upper portion and the lower portion, a second planar side wall spaced apart from the first planar side wall, and extending between the closed upper portion and the lower portion, a front wall extending between the first planar side wall and the second planar side wall, and a back wall opposite and spaced apart from the front wall, and extending between the first planar side wall and the second planar side wall, wherein a surface of the closed upper portion extends from an upper portion of the first planar side wall to an upper portion of the second planar side wall and has a curved profile therebetween, wherein the curved profile includes a portion of the surface extending in a direction away from the upper portions of the first planar side wall and the second planar side wall.

16. The exposed perforating gun system of claim 15, wherein the shaped charge closure member further comprises:

a skirt extending downwardly from each of the first and second planar side walls, the front wall, and the back wall, wherein the skirt has a substantially rectangular cross-section and is positioned over the open portion of the rectangular case.

17. The exposed perforating gun system of claim 16, wherein the hollow interior includes:

a first hollow interior portion bounded by the skirt;

a second hollow interior portion bounded by the closed upper portion; and a third hollow interior portion extending between the first and second hollow interior portions, wherein the second hollow interior portion and the third hollow interior portion collectively form an air gap that facilitates complete formation of a forward-moving jet that pierces the closed upper portion of the closure member at the forward-moving jet's maximum velocity.

18. The exposed perforating gun system of claim 15, wherein the shaped charge closure member composed of a polymer comprising a thermoplastic material.

19. The exposed perforating gun system of claim 15, wherein:

the first and second planar side walls have a substantially trapezoidal shape; and the planar front wall and the planar back wall have a substantially rectangular shape.

20. The exposed perforating gun system of claim 15, wherein the skirt comprises an engagement member that engages the external surface of the rectangular case.

* * * * *